US012378479B2

(12) United States Patent
Wiens et al.

(10) Patent No.: US 12,378,479 B2
(45) Date of Patent: Aug. 5, 2025

(54) TECHNIQUES TO MITIGATE STRIPPER FOULING IN FLUID COKERS

(71) Applicant: SYNCRUDE CANADA LTD. in trust for the owners of the Syncrude Project as such owners exist now and i, Edmonton (CA)

(72) Inventors: Jason Wiens, Edmonton (CA); Gibran Alamgir, Edmonton (CA); Chung Huu Ta, Edmonton (CA); Michael Wormsbecker, Edmonton (CA)

(73) Assignee: SYNCRUDE CANADA LTD. in trust for the owners of the Syncrude Project as such owners exist now and in the future, Edmonton (CA)

( * ) Notice: Subject to any disclaimer, the term of this patent is extended or adjusted under 35 U.S.C. 154(b) by 159 days.

(21) Appl. No.: 18/364,447

(22) Filed: Aug. 2, 2023

(65) Prior Publication Data

US 2025/0043193 A1 Feb. 6, 2025

(51) Int. Cl.
*C10G 9/32* (2006.01)
*C10G 9/00* (2006.01)

(52) U.S. Cl.
CPC ..... *C10G 9/005* (2013.01); *C10G 9/32* (2013.01); *C10G 2300/1037* (2013.01); *C10G 2300/708* (2013.01)

(58) Field of Classification Search
CPC ..... C10G 9/005; C10G 9/32
See application file for complete search history.

(56) References Cited

U.S. PATENT DOCUMENTS

| | | | | |
|---|---|---|---|---|
| 7,914,668 | B2 * | 3/2011 | Siskin | C10B 1/04 208/131 |
| 10,703,979 | B1 * | 7/2020 | Wormsbecker | C10B 55/10 |
| 2011/0114468 | A1 * | 5/2011 | Davuluri | C10B 55/10 202/241 |
| 2016/0312126 | A1 * | 10/2016 | Wormsbecker | C10B 55/10 |
| 2019/0194549 | A1 * | 6/2019 | Dubois | C10G 9/32 |

OTHER PUBLICATIONS

Song et al., "Hydrodynamics of the reactor section in fluid cokers", Powder Technology, 2004, 147: 126-136.
Bi et al., "Flooding of Gas-Solids Countercurrent Flow in Fluidized Beds", Ind. Eng. Chem. Res., 2004, 43, pp. 5611-5619.

* cited by examiner

*Primary Examiner* — Renee Robinson
(74) *Attorney, Agent, or Firm* — Knobbe, Martens, Olson & Bear, LLP

(57) ABSTRACT

A fluid coking operation for converting bitumen to lighter hydrocarbons can be controlled or monitored using a stripper fouling indicator to mitigate foulant accumulation on the sheds of the stripper within the lower section of the coker and avoid flooding. The stripper fouling indicator can be linked to the liquid carry-under to the stripper which can be correlated to certain measurable variables such as which feed nozzles are used for bitumen injection, solids circulation rate of the coke particles, and reactor temperature. The coking can be kept below the stripper fouling indicator to avoid flooding while operating with high yield and performance.

17 Claims, 4 Drawing Sheets

TECHNIQUES TO MITIGATE STRIPPER FOULING IN FLUID COKERS

TECHNICAL FIELD

The technical field generally relates to operating fluid cokers, and more particularly to techniques to mitigate stripper fouling in fluid cokers.

BACKGROUND

Fluid cokers are used to thermally convert heavy hydrocarbons, such as oil sands bitumen, to lighter and higher-value hydrocarbon products. The bitumen can be supplied to a reactor onto a bed of hot coke particles and the hydrocarbon products are recovered as an overhead stream. In a lower region of the reactor, a stripper is provided and steam is fed up through the stripper. The hot coke particles are circulated through the reactor and are maintained in a fluidized state. The coke particles are hot upon entry into the reactor and fall through the reactor past the stripper before being withdrawn from the reactor, reheated in an external burner and then returned into the reactor. Proper operation of the stripper within the coker reactor is relevant for performance of the coking process. There is indeed a need for a technology that facilitates performance of the stripper in fluid cokers.

SUMMARY

In some implementations, there is provided a process or system for subjecting bitumen to a fluid coking operation, comprising: feeding the bitumen into a reactor; circulating coke particles through the reactor to contact the bitumen and cause cracking to produce hydrocarbon products; removing the hydrocarbon products via an upper outlet of the reactor; monitoring process parameters of the fluid coking operation; and controlling operation of the reactor based on a stripper fouling indicator of a stripper located in a lower region of the reactor and based on the monitored process parameters of the fluid coking operation.

In some implementations, the process parameters comprise usage of feed nozzles through which the bitumen is fed into the reactor; the process parameters comprise a solids circulation rate of the coke particles; the process parameters comprise a reactor temperature of the reactor; the stripper fouling indicator is based on liquid carry-under to the stripper; the stripper fouling indicator is developed based on a modelling of relations between the process parameters and liquid carry-under to the stripper. In some implementations, the modelling comprises: developing a model based on reactor temperature, circulation rate, feed nozzles in operation, and breakthrough times to the stripper for individual feed levels at which the feed nozzles are located, such that the model predicts the liquid carry-under to the stripper; tuning the model using turnaround stripper fouling as-found data to establish limits on the liquid carry-under resulting in excessive stripper fouling leading to flooding; and determining excess cumulative liquid carry-under (ECLC) which predicts stripper foulant accumulation; and identifying an ECLC threshold below which stripper foulant accumulation is acceptable for operation. In some implementations, the modelling further comprising accounting for an impact of wall coke thickness within the reactor on the breakthrough times for the individual feed levels; the feed nozzles are arranged in at least three vertically spaced-apart rings within the reactor, each ring being at a defined height within the reactor; the controlling of the reactor comprises adjusting process variables to maintain the predicted stripper fouling indicator below a predetermined threshold; the predetermined threshold comprises an excess cumulative liquid carry-under (ECLC) threshold of the stripper above which stripper flooding is probable to occur; the predetermined threshold comprises a liquid carry-under rate threshold above which fouling onset or fouling accumulation are probable to occur; the predicted stripper fouling indicator comprises an excess cumulative liquid carry-under (ECLC), and wherein the determined ECLC indicates whether there is a low probability of stripper flooding, an uncertain probability of stripper flooding, and a likely probability of stripper flooding; the controlling of the reactor comprises adjusting process variables to avoid flooding of the stripper; the controlling of the reactor comprises determining and monitoring the predicted stripper fouling indicator over time during operation of the reactor. In some implementations, the controlling of the reactor comprises, in response to an increase in the predicted stripper fouling indicator: increasing the reactor temperature; selecting feed nozzles located at a higher elevation within the reactor for injection of the bitumen into the reactor; and/or decreasing the solids circulation rate through the reactor. In some implementations, the controlling of the reactor comprises, in response to an increase in the predicted stripper fouling indicator, increasing the reactor temperature. In some implementations, the stripper comprises a plurality of sheds extending into a downward flow path within the reactor and the controlling of the reactor mitigates fouling of the sheds of the stripper. In some implementations, the controlling of the reactor comprises: monitoring a plurality of coking operation variables; and displaying the coking operation variables, including the stripper fouling indicator, on a dashboard for an operator.

In some implementations, there is provided a coking system for subjecting bitumen to a fluid coking operation, comprising a reactor comprising: a bitumen feed assembly for feeding the bitumen into a reactor; a particle inlet coupled to a side of the reactor and a particle outlet coupled to a bottom of the reactor, wherein the particle inlet, the particle outlet and the reactor are configured for circulating coke particles through the reactor to contact the bitumen and cause cracking to produce hydrocarbon products; an upper outlet for removing the hydrocarbon products from the reactor; and a stripper located in a lower region of the reactor. The coking system also includes a burner in fluid communication with the particle outlet for receiving and heating the coke particles, and in fluid communication with the particle inlet for providing heated coke particles back into the reactor; a monitoring system operationally coupled to the reactor for the monitoring process parameters of the delaying coking operation; and a control unit operationally coupled to the monitoring system for receiving data therefrom and operationally coupled to the reactor for controlling and/or monitoring operation thereof based at least in part on a stripper fouling indicator of the stripper and on the monitored process parameters of the reactor. The coking system can have various units and operating configurations in line with the present description.

In some implementations, there is provided a method of controlling or monitoring operation of a reactor of a fluid coking operation, comprising obtaining process parameters of the fluid coking operation; and determining a stripper fouling indicator of a stripper located in a lower region of the reactor and based on the obtained process parameters of the fluid coking operation. The stripper fouling indicator can then be used to monitor fouling of the stripper and/or controlling the fluid coking operation by adjusting one or more process variables.

It is also noted that various additional features described herein can be combined together in connection with the process and/or system in various combinations.

BRIEF DESCRIPTION OF THE DRAWINGS

The attached figures illustrate various features, aspects and implementations of the technology described herein.

DETAILED DESCRIPTION

The present description relates to mitigating stripper fouling in fluid cokers. It is known that excessive fouling of the coker stripper can lead to an operational problem known as flooding. Flooding of the coker stripper reduces the solids circulation between the reactor and the burner, resulting in reduced or inadequate supply of heat to drive the cracking reactions within the reactor. This reduced heat supply can limit the bitumen feed rates that can be sustained in the reactor and therefore reduces performance and yield.

In a fluid coker, stripper fouling can be mitigated by implementing process control of the reactor where a set of process parameters is used to determine a stripper fouling indicator which can be linked to the rate of liquid carry-under to the stripper. For example, the set of process parameters can be correlated with stripper fouling, such that the process can include monitoring the process parameters to indirectly determine stripper fouling and/or to adjusting the process with respect to a threshold rate of liquid carry-under to avoid fouling. In one example, the set of process parameters includes reactor temperature, solids circulation rate, and feed nozzles in operation, which are relatively straightforward parameters to measure and adjust. The process control strategy can include first developing a kinetic model based on the process parameters to determine relationships between the parameters and the rate of liquid carry-under to the stripper and fouling, and then operating the fluid coker to maintain the process within a non-fouling regime or to enable real-time prediction of fouling that may be occurring in order to adjust the process accordingly.

It is noted that no techniques currently exist to quantify the state of stripper fouling while the reactor unit is online. The indication of excessive fouling in the fluid coker stripper is when a flooding event occurs and leads to process upset that must be remediated, for example through stripper shed lancing. Fluid cokers currently set their operation temperature according to certain methods, but such techniques do not consider the tendency for stripper fouling to occur.

Operating the coker based on a stripper fouling indicator, which can be linked to liquid carry-under from the feed zone to the stripper, in order to mitigate stripper fouling and avoid flooding facilitates enhanced performance of cokers that may have a tendency toward stripper fouling using other process control methods. Whereas common practice in such units is to operate at high temperatures, operating at lower or minimal temperatures to optimize yield while avoiding stripper flooding or fouling represents a notable value proposition and is facilitates by the present technology.

Figure 1:
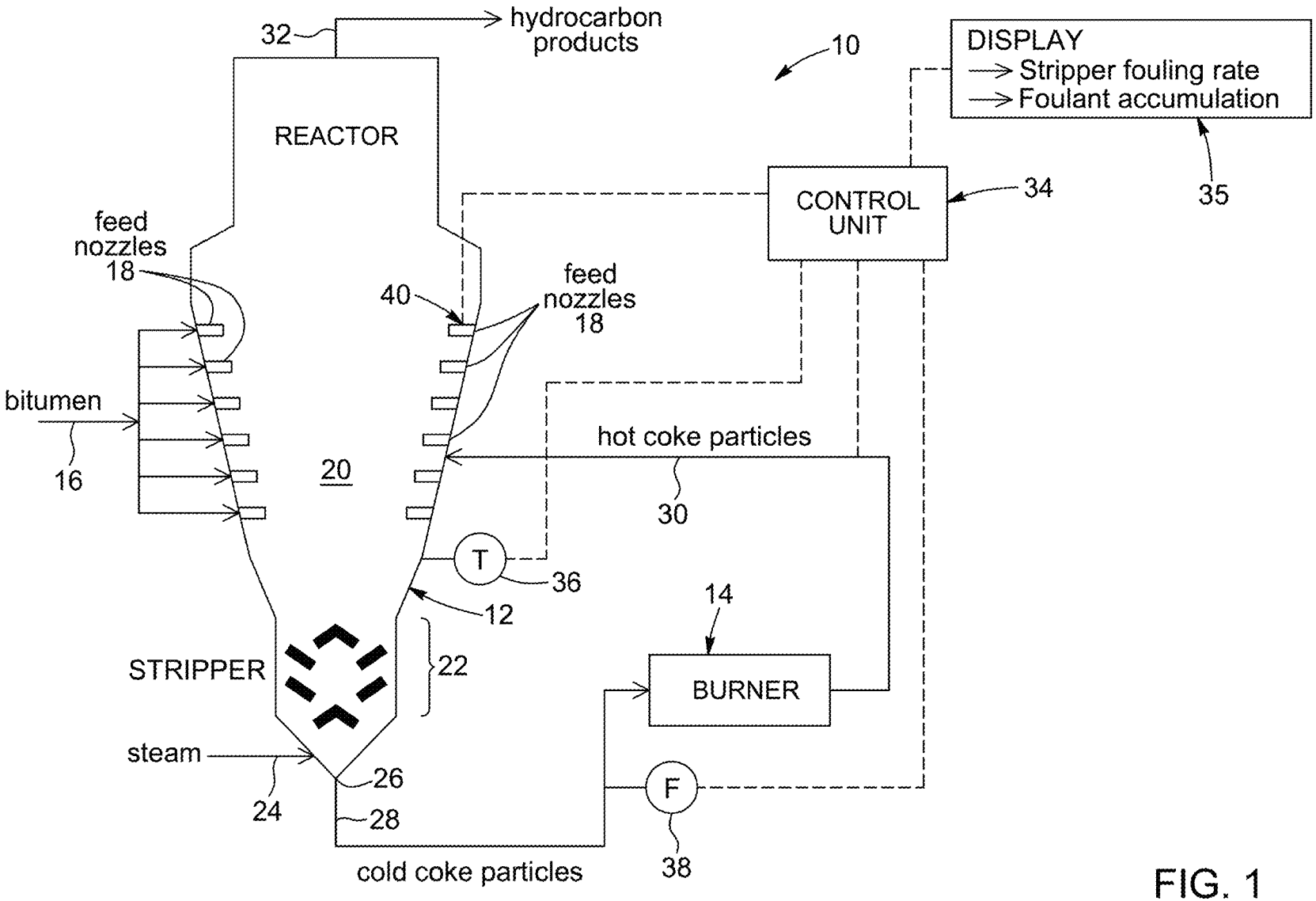
FIG. 1 shows an example fluid coking system.

Referring to FIG. 1, a coker system 10 is shown including a reactor 12 and a burner 14. The reactor 12 has a bitumen feed line 16 that can supply bitumen to multiple nozzles 18 for introducing the bitumen into a main chamber 20 of the reactor 12. The reactor 12 also has a stripper 22 in a lower region below the main chamber 20, a steam inlet 24 below the stripper 22, and a solids outlet 26. The solids outlet 26 is configured to remove the cooled coke particles and is connected to an outlet line 28 that supplies the coke particles to the burner 14. The burner 14 heats the coke particles to produce hot coke particles which are then fed back into the reactor 12 via a solid inlet line 30. The reactor 12 also includes an overhead outlet 32 where the hydrocarbons products are removed and then sent for further processing.

FIG. 1 also illustrates a monitoring or control unit 34 that is operatively coupled to the coker system 10. The unit 34 can be configured for monitoring that provides input to a larger control system that is used to control various processes within an oil sands mining and extraction facility. The unit 34 could alternatively be configured as a dedicated control unit 34 configured to receive measured process parameters and to control one or more process parameters based on predetermined models. For example, the unit 34 can be configured to receive reactor temperature data, solids circulation data, and nozzle usage data (e.g., which nozzles are actively injecting bitumen and which are closed). The unit 34 can also be configured to determine a predicted liquid carry-under rate based on the input data and according to predetermined derived models. If the predicted liquid carry-under rate exceeds a threshold value such that high fouling is likely occurring, then the unit 34 can send the information to a central control system to adjust one or more process variables to reduce the liquid carry-under rate and thus mitigate stripper fouling issues. For instance, the control system could increase the reactor temperature (e.g., by increasing coke heating in the burner), increase the distance between bitumen injection point and the stripper (e.g., by injecting bitumen via a nozzle that is further away from the stripper), decrease solid coke circulation and/or reduce bitumen feed rate. In addition, the predicted liquid carry-under rate can be monitored over time in real time to observe the evolution over time and take action, if necessary, prior to approaching the fouling-onset threshold or prior to higher-risk fouling levels. FIG. 1 shows example instrumentation including a temperature sensor 36, a flow determination module 38 (e.g., flow meter or flow calculation module that determines flow based on other variables) and a nozzle measurement device 40 that can obtain and supply information to the unit 34. It should be noted that multiple sensors can be deployed at various positions around the coker system to measure certain properties and relay to the unit 34. For example, temperature sensors can be provided at multiple locations of the reactor 12 to obtain temperature profile data of the reactor 12.

The monitoring unit 34 can be configured and operated with input from a model for predicting stripper fouling. The model for predicting stripper fouling can be developed using various methods, including mathematical methods based on first principles and statistical methods, for example. As will be explained further below, an example mathematical model was developed to predict the amount of unreacted liquid carry-under traveling from each nozzle to the top of the stripper and notable operating conditions for stripper fouling were identified. It was found that the reactor temperature, solids circulation rate, feed nozzles in operation, and breakthrough times from the main reactor chamber to the stripper for the individual feed rings could be used to predict the quantity of liquid that was carried under to the stripper sheds over each run, and thus infer the extent of stripper shed fouling. The model was tuned using turnaround stripper fouling as-found data to establish limits on the liquid carry-under that would lead to excessive stripper fouling that could subsequently result in flooding. The unit 34 can also be operatively coupled to a control system that has a display unit 35 that includes a dashboard displaying various information on the process, including stripper fouling information based on the model (e.g., predicted liquid carry-under rate, ECLC, etc.) for an operator.

In one implementation, it was found that the model predicts that when the average daily liquid to stripper was greater than an upper threshold value, which may be in units of volumetric flow rate per, there was a significant accumulation of foulant at the end of the run. Based on this prediction, a set of operating conditions was established where liquid carry-under is subdued such that foulant does not accumulate appreciably in the stripper over the course of an operating cycle.

More regarding model development and related features and findings will be described further below.

Experimentation & Modelling

A mathematical model was developed to predict the amount of unreacted liquid carry-under traveling from each nozzle to the top of the stripper to identify operating conditions that would eliminate excessive stripper fouling over the course of a target operating cycle. The reactor temperature, circulation rate, feed nozzles in operation, and breakthrough times from the reactor to stripper for the individual feed rings were used to predict how much liquid was carried under to the stripper sheds in a commercial coker (hereafter referred to as Coker A) over each run, and thus infer the extent of stripper shed fouling. The model was tuned using turnaround stripper fouling as-found data to establish limits on the liquid carry-under that would lead to excessive stripper fouling that could subsequently result in flooding. The model predicts that when the rate of liquid to stripper was greater than a certain threshold, there was a significant accumulation of foulant at the end of the run. Based on this prediction, a set of operating conditions was established where liquid carry-under is subdued such that foulant does not accumulate appreciably in the stripper over the course of an operating cycle.

In terms of model development, the following provides an example for an example commercial fluid coker referred to as Coker A. The example model has been used for stripper fouling mitigation in Coker A according to methods described herein.

Breakthrough Time

A well-mixed system with equal concentration throughout is characterized as a continuously stirred tank reactor (CSTR). It is assumed that the mixture is instantaneously and perfectly mixed with no lag between a flow unit or particle entering and exiting the reactor. In reality, commercial process vessels are rather large and have a notable lag due to material moving through the system. This lag can be referred to as breakthrough time and it can be used to understand how particles flow through the dense bed and the mixing characteristics of the process. It is mainly affected by the distance between the inlets and the outlets and the velocity of solids mixing in the reactor bed. The simple definition of breakthrough time in the coker is shown below:

$$\text{Breakthrough time} = \frac{\text{Distance between Feed nozzles and the Top of Stripper}}{\text{velocity}}$$

Figure 2:
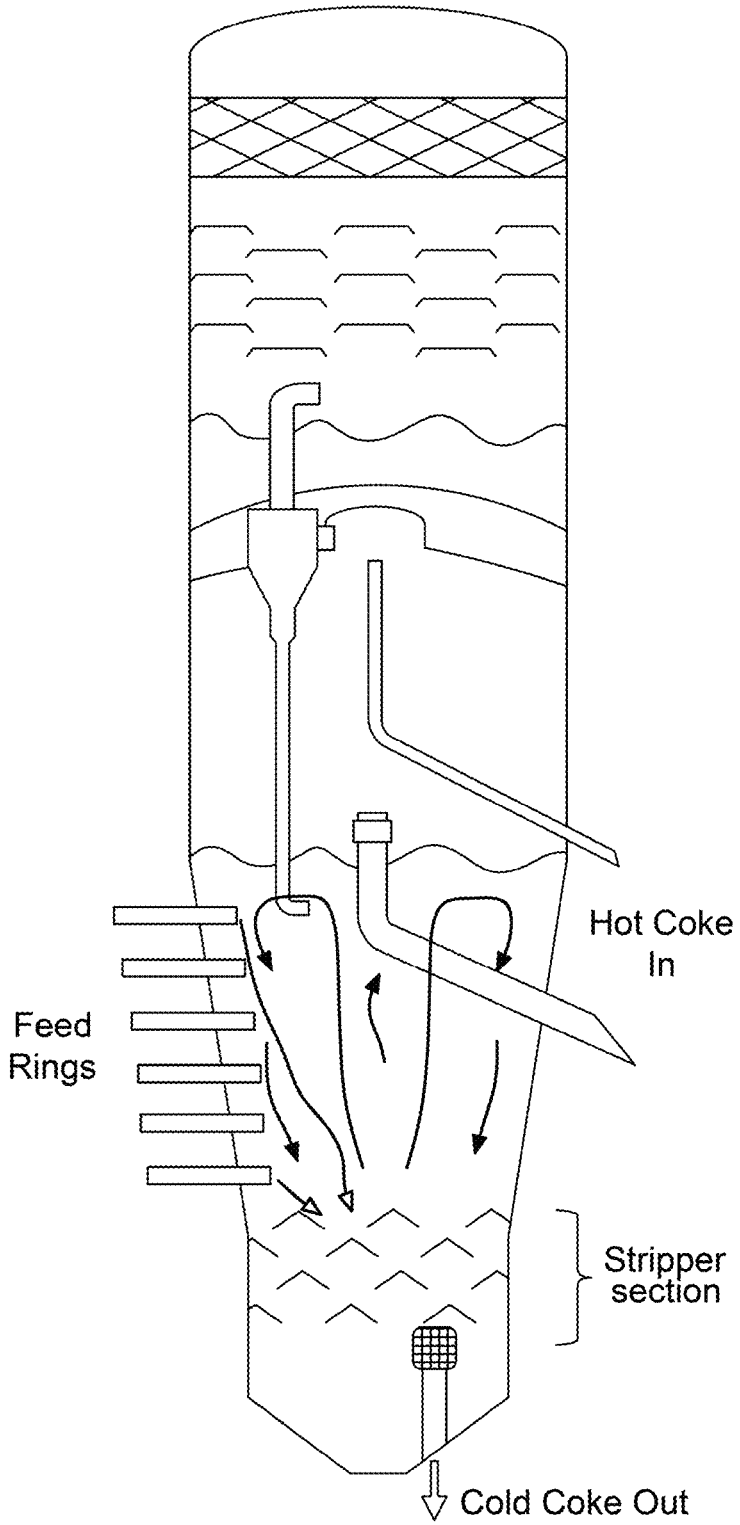
FIG. 2 shows an example coker reactor.

Referring to FIG. 2 and considering the movement of solids in Coker A, one can understand the delay in hot coke entering through the transfer line and feed nozzles, moving down the reactor, and exiting through the so-called sore thumb. This delay, the breakthrough time, was determined using a computer-based compartment mixing model. FIG. 2 depicts how particles generally flow inside the dense bed in the reactor unit of the coker, where black lines indicate fluid coke inlets/outlets, blue lines indicate solids mixing due to bubbles, and red lines indicate the distance leading-edge solids wetted by coker feed must travel to reach the stripper.

A mixing model was developed a cold flow coker model. The model solves ordinary differential equations (ODEs) using mixing parameters to represent the "real system". The computer-based mixing model was used to estimate the breakthrough times for the commercial coker and data scaled well to commercial breakthrough time data from tracer studies.

Figure 3:
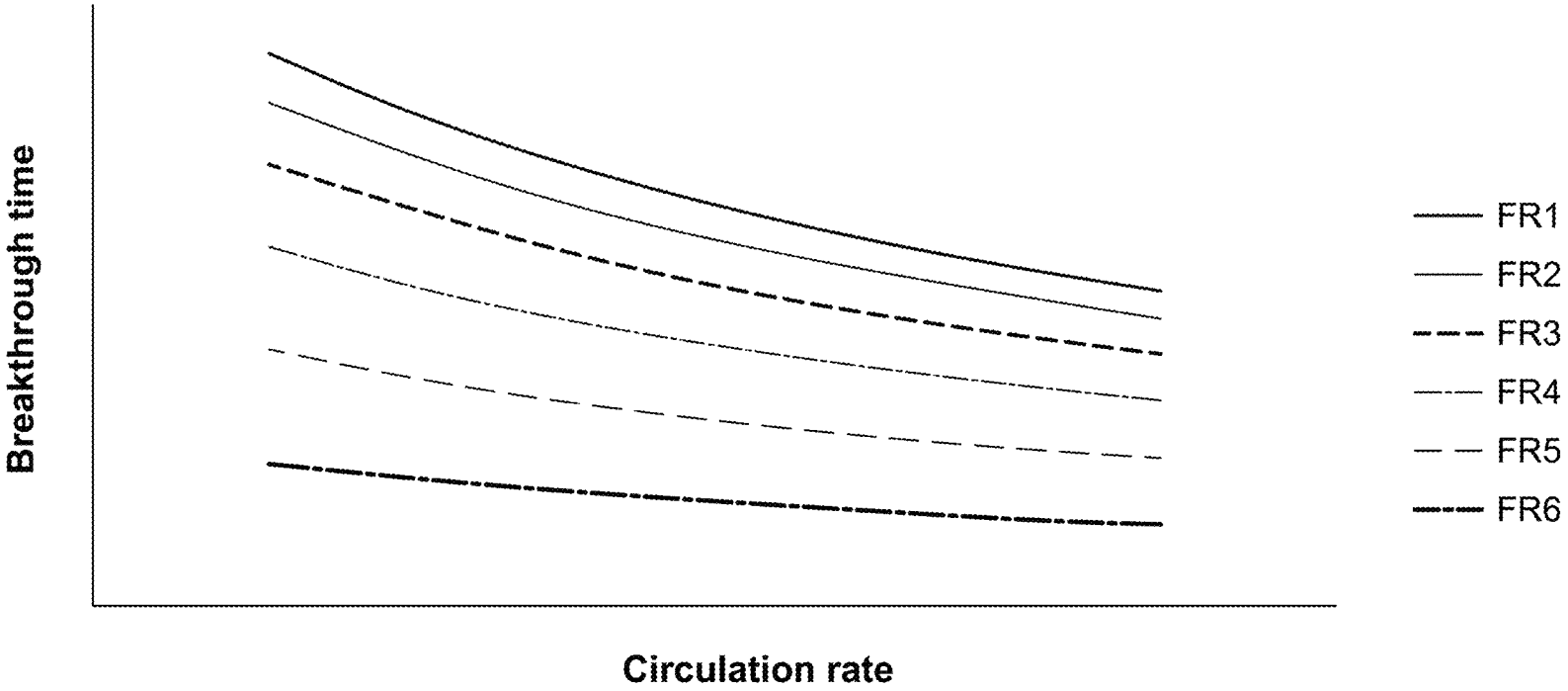
FIG. 3 is a graph of breakthrough time versus circulation rate for different feed nozzle rings.

The baseline operating conditions represent scaled-down model parameters to simulate Coker A operation at nameplate capacity. Only operations with all six feed rings turned on are tested with flow distributed evenly between the operating feed rings. The time taken for particles to travel from each feed ring (FR1-FR6) to the top-of-stripper (TOS) location is measured individually by specifying the tracer injection point feed ring using values ranging from 1 to 6 (1 representing FR1 and 6 representing FR6). The retention time distribution (RTD) curves for each feed ring injection are then extracted to determine the characteristic breakthrough time. This can be done by measuring the time taken for a certain percentage (e.g., 1-5%) of the cumulative feed to reach the TOS. This is then repeated for different circulation rates ranging from 50 TPM to 90 TPM for the commercial cokers. The breakthrough times are then scaled for the commercial units using scaling factors calculated using Glickman's law (see Song, X., Grace, J. R., Bi, X., Lim, C. J. "Hydrodynamics of pressurized cold model for Syncrude Cokers (June 2001 to December 2003)". SCL Research Progress Report. Call No. 665.533 S69, 2003). FIG. 3 shows a graph of breakthrough time versus circulation rate for the feed ring operation. The breakthrough times for feed rings 5 and 6 are much shorter than the feed rings above them. It is also seen that at higher circulation rates, the breakthrough time is shorter. However, the relative impact of circulation rate on breakthrough time is less compared to the effect of which feed rings are in operation. Because of this, it is anticipated that preferentially deploying nozzles on higher feed rings would have a more substantial impact than circulation. After calculating the breakthrough time, the amount of wetted feed reaching the TOS was calculated using reaction kinetics and a mass balance to determine the amount of liquid carry-under and stripper shed fouling.

Reaction Kinetics and Mass Balance

Since the reactor bed temperature is not constant throughout a run, the kinetic rate constant is corrected for reactor temperature to predict the amount of liquid carry-under to the TOS and stripper shed fouling. The kinetic parameters used in this model were the kinetic rate constant for first order thermal cracking of 698° C.+ pitch and activation energy. The kinetic rate constant for thermal conversion was adjusted for reactor operating temperature using the Arrhenius equation (Equation 1). The calculated kinetic rate constant varied between values that were below 0.5 $s^{-1}$ with a change in bed temperatures from 530 to 550° C.

$$k = k_{pitch} e^{\frac{E_a}{R}\left(\frac{1}{T_{ref}} - \frac{1}{T_{bed}}\right)} \tag{1}$$

A mass balance is then carried out to determine how much of the feed reacts by the time it reaches the TOS at the specific reactor bed temperature. The mathematical model is based on the following assumptions:

Cracking reactions for all boiling range material follow a simplified conversion from fouling material to non-fouling material according to the first order reaction of pitch.

$$\text{Fouling feed} \xrightarrow[\text{kpitch}]{} \text{Nonfouling product}$$

The lowest residence time feed (fastest breakthrough time) would contribute the most to stripper shed fouling. Although the compartment model in FIG. 3 is the most accurate representation of coker hydrodynamics, the kinetics were assumed to be represented as a plug flow reactor with a residence time equal to the modeled breakthrough time for the purposes of predicting the fouling. This is done to reduce the computational complexity to facilitate extraction of fouling predictions when implemented in process control schemes, such as the process control methods described herein.

The rate of reaction of the liquid film drying is a first-order reaction in terms of the heaviest pitch fraction.

The density of the feed is assumed to be 1 g/$cm^3$ with the volume in the 1-D solids mixing model tanks held constant (flow of coke into the reactor is equal to the flow out of the reactor). Feed density does not vary with extent of reaction.

There is no temperature gradient, and the reactor temperature is uniform throughout the entire dense bed.

Each feed nozzle in service delivers a consistent volumetric flowrate of feed that has an identical boiling distribution regardless of the actual feed stream distribution to the reactor.

Stripper shed fouling is caused by a gradual accumulation of foulant resulting from the chosen set of operating conditions. Foulant resulting from upset conditions, such as feed outages, and other abnormal operating scenarios are not considered in the model.

The overall mass balance simplifies to:

$$\frac{d(\rho Q w_f)}{dt} = -\rho Q k w_f \tag{2}$$

By assuming that density is invariant with extent of reaction the mass and volume fractions are equivalent:

$$Q_f(t) = Q_{f0} e^{-kt} \tag{3}$$

Liquid Carry-Under

The total amount of unreacted liquid coke traveling to the TOS for Coker A is calculated using the breakthrough times from the computer-based model, the kinetic rate constant from the Arrhenius equation (1), and the total feed rate into the cokers of Coker A. The total feed rate through each feed ring is calculated by multiplying the number of feed nozzles in operation in each ring with the average flow rate through each nozzle per day. The contribution of unreacted liquid reaching the TOS from each feed ring is then calculated and added up to get the total liquid carry-under. The formula used to calculate the total amount of liquid carry-under is given in equation 4.

$$\text{Cumulative liquid carry} - \text{under} = \sum_{i=1}^{6} n_i * f * e^{-kt_i} \tag{4}$$

The model was assessed and tuned based on a variety of coker data. Coker operation and the use of the model are discussed further below.

The extent of stripper fouling in cokers was assessed using turnaround as-found photographs of stripper shed rows. The amount of wet feed reaching the stripper per day predicted by the model was then compared to documentation as found during turnarounds to validate the model.

The model predicts that reactor temperature and feed ring usage are the strongest predictor of stripper shed fouling, with circulation rate having a comparatively smaller impact. Utilizing lower feed rings (particularly rings 5 and 6) at low reactor temperatures is predicted to be the most severe operation from a stripper fouling perspective. Such an operating scenario frequently occurs during periods of low reactor feed, where the reactor frequently operates at a reactor minimum temperature. It is possible to remove low ring nozzles from service during extended periods of low throughput. Based on turnaround documentation and model predictions of the amount of unreacted liquid sent to the stripper, it was observed that accumulation of foulant was generally lower when the predicted average daily liquid to the stripper was lower. More specifically, when the predicted average liquid to stripper per day was below a threshold, there was generally little to no foulant accumulation. Based on this observation, it was concluded that operation where the calculated liquid to stripper was below a determined kbbl/day value would accumulate negligible foulant and thus represents a good operating scenario from a stripper fouling perspective (hence referred to as the 'threshold' liquid carry-under). It was found that the extent of stripper foulant accumulation was best predicted by the total amount of wet feed reaching the TOS above this threshold (hence referred to as the excess cumulative liquid carry-under, ECLC). The ECLC is calculated using equation 5.

$$ECLC = \sum_{i=1}^{days} (\text{Daily liquid carry under})_i - 0.1 \tag{5}$$

While the ECLC was calculated by summing the daily liquid carry-under over the course of the run, it is noted that time scales other than day basis could be used. For example, the ECLC could sum the hourly, half-daily or weekly liquid carry under. It was found that the ECLC could be based on the sum of daily liquid carry-under with good results.

The liquid carry-under method was also assess in relation to other methods. Based on the analysis, it was seen that the model predicted ECLC to stripper showed increased accuracy. The model was able to define a clear threshold for the daily average liquid to stripper above which significant foulant accumulation was observed on the stripper sheds. No such threshold could be defined for the other method. In particular, the fouling model predicts that operation at the minimum reactor temperature (this operating condition occurs at low feed rates) can lead to high carry-under of liquid to the stripper even though the alternative method indicated acceptable operation in these scenarios. There was also a direct correlation between the ECLC and the extent of stripper fouling for almost all runs making it easier to predict the extent of stripper fouling and adjust operating conditions to ensure the rate of foulant accumulation is suppressed.

Figure 4:
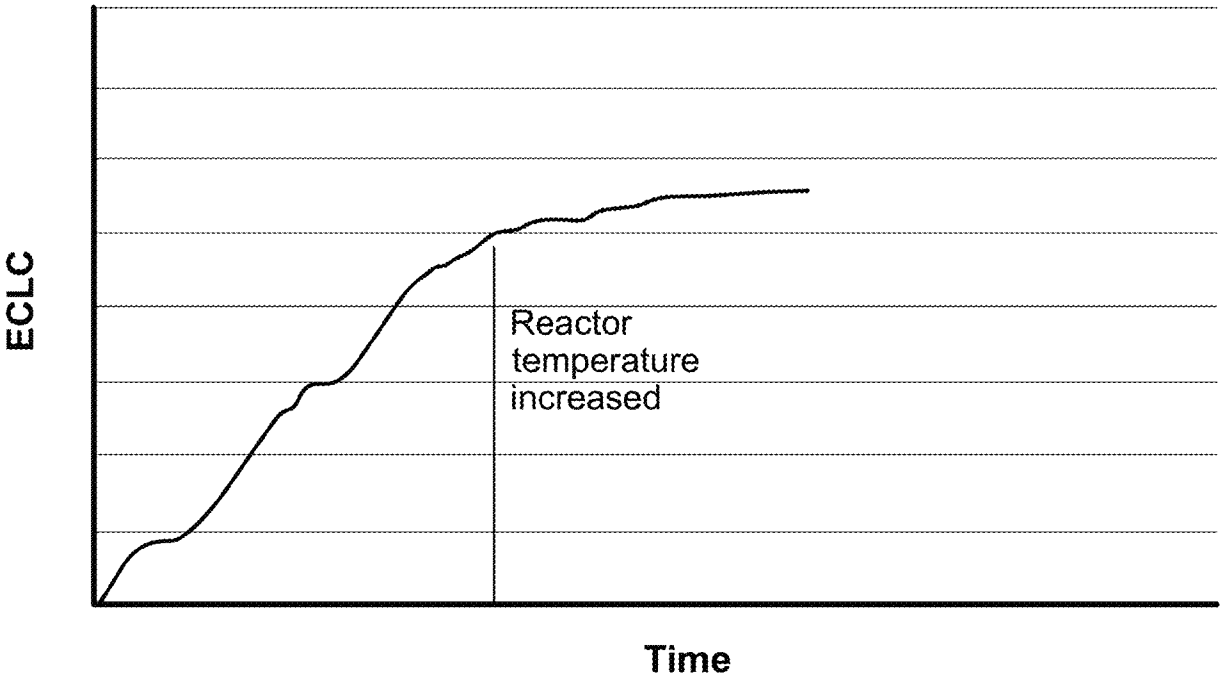
FIG. 4 is a graph of excess cumulative liquid carry-under (ECLC) versus time.

For another coker test run, the calculated ECLC to the stripper was determined to be around 110 kbbls during operation. If the ECLC were to continue to increase, there is a high chance of a stripper flooding incident due to extensive stripper shed fouling before turnaround. As a part of the mitigation steps to reduce the rate of stripper foulant accumulation in the coker, the reactor temperature was increased. The model predicts that the rate of foulant growth has decreased at these modified operating conditions. FIG. 4 shows the ECLC on the stripper sheds and how increased reactor temperature reduced the rate of liquid carry-under to the stripper sheds.

Example Implementations of Model

The model can be implemented as part of an overall process control and monitoring strategy. In one example, the model can be used to track the ECLC and use it to predict the extent of stripper fouling. The model can be used to calculate the daily liquid carry-under (or the carry-under on another time basis) based on the operating conditions and help specify reactor temperature to operate below a target threshold.

In addition, for ongoing and future coker operations, as-found conditions of the stripper during turnarounds can be used to establish limits on the ECLC in order to reduce the probability of experiencing stripper flooding over the course of an operating cycle. For example, stripper flooding was considered likely at an upper ECLC value and has occurred at approximately 15-25% above the upper ECLC value, and previous runs where the extent of stripper fouling was considered manageable had a maximum ECLC of approximately 40-45% of the upper ECLC value. Therefore, in some implementations of coker operations, up to a manageable-fouling ECLC can be considered a reasonable limit to avoid flooding issues, between the upper ECLC value and the manageable-fouling ECLC can be considered as uncertain and having a higher risk of flooding, while the upper ECLC value can be taken as an upper threshold to avoid flooding and is not recommended.

Of course, since coker equipment and coking process parameters such as temperature and feed composition vary from case to case, it should be understood that particular operating envelopes and thresholds based on ECLC or other stripper fouling indicators can be adapted based on modelling of the particular coking system.

Findings

A model was developed to predict the extent of stripper fouling based on operating temperature, circulation rate and feed nozzles in service. The model predicts the severity of fouling in cokers based on the daily liquid carry-under reaching the stripper shed rows. It was predicted that stripper shed fouling accumulates when the liquid to stripper is above a threshold and the extent of fouling is highly correlated to the liquid to stripper above this threshold. Stripper fouling was observed to be severe when the excess cumulative liquid carry under (ECLC) to the stripper above an identified threshold for the coker system. Thus, the liquid carry-under rate (e.g., daily) as well as the total liquid carry-under can be used in coker process control. This model can be deployed on a process control platform, which can include displaying relevant variables including the ECLC and liquid carry-under rate to an operator, to predict the extent of stripper fouling by tracking the accumulated wet liquid sent to the stripper sheds over time during a coker run. It is estimated that running cokers based on the recommended operating conditions from the model can represent notable economic savings by ensuring reliable operation. The model notably predicts the gradual accumulation of wet feed to the stripper.

Using the stripper fouling model can have a number of advantages for coking operations, such as avoiding stripper flooding. It is also possible to employ a hybrid process control strategy that uses both the conventional methods and stripper fouling model (e.g., the temperature required to achieve a desired factor based on conventional methods and the temperature required to achieve a liquid carry-under to the stripper that is lower than the threshold can both be calculated and the higher temperature of the two is selected).

Several alternative implementations and examples have been described and illustrated herein. The implementations of the technology described above are intended to be exemplary only. A person of ordinary skill in the art would appreciate the features of the individual implementations, and the possible combinations and variations of the components. A person of ordinary skill in the art would further appreciate that any of the implementations could be provided in any combination with the other implementations disclosed herein. It is understood that the technology may be embodied in other specific forms without departing from the central characteristics thereof. The present implementations and examples, therefore, are to be considered in all respects as illustrative and not restrictive, and the technology is not to be limited to the details given herein. Accordingly, while the specific implementations have been illustrated and described, numerous modifications come to mind.

The invention claimed is:

1. A process for subjecting bitumen to a fluid coking operation, comprising:

feeding the bitumen into a reactor;

circulating coke particles through the reactor to contact the bitumen and cause cracking to produce hydrocarbon products;

removing the hydrocarbon products via an upper outlet of the reactor;

monitoring process parameters of the fluid coking operation; and controlling operation of the reactor based on a stripper fouling indicator of a stripper located in a lower region of the reactor and based on the monitored process parameters of the fluid coking operation wherein the stripper fouling indicator is developed based on a modelling of relations between the process parameters and liquid carry-under to the stripper.

2. The process of claim 1, wherein the process parameters comprise usage of feed nozzles through which the bitumen is fed into the reactor.

3. The process of claim 2, wherein the feed nozzles are arranged in at least three vertically spaced-apart rings within the reactor, each ring being at a defined height within the reactor.

4. The process of claim 1, wherein the process parameters comprise a solids circulation rate of the coke particles.

5. The process of claim 1, wherein the process parameters comprise a reactor temperature of the reactor.

6. The process of claim 1, wherein the modelling comprises:

developing a model based on a reactor temperature, circulation rate, feed nozzles in operation, and breakthrough times to the stripper for individual feed levels at which the feed nozzles are located, such that the model predicts the liquid carry-under to the stripper;

tuning the model using turnaround stripper fouling as-found data to establish limits on the liquid carry-under resulting in excessive stripper fouling leading to flooding;

determining excess cumulative liquid carry-under (ECLC) which predicts stripper foulant accumulation; and identifying an ECLC threshold below which stripper foulant accumulation is acceptable for operation.

7. The process of claim 6, wherein the modelling further comprising accounting for an impact of wall coke thickness within the reactor on the breakthrough times for the individual feed levels.

8. The process of claim 1, wherein the controlling of the reactor comprises adjusting process variables to maintain the stripper fouling indicator below a predetermined threshold.

9. The process of claim 8, wherein the predetermined threshold comprises an excess cumulative liquid carry-under (ECLC) threshold of the stripper above which stripper flooding is probable to occur.

10. The process of claim 8, wherein the predetermined threshold comprises a liquid carry-under rate threshold above which fouling onset or fouling accumulation are probable to occur.

11. The process of claim 1, wherein the stripper fouling indicator comprises an excess cumulative liquid carry-under (ECLC), and wherein the ECLC indicates whether there is a low probability of stripper flooding, an uncertain probability of stripper flooding, and a likely probability of stripper flooding.

12. The process of claim 1, wherein the controlling of the reactor comprises adjusting process variables to avoid flooding of the stripper.

13. The process of claim 1, wherein the controlling of the reactor comprises determining and monitoring the stripper fouling indicator over time during operation of the reactor.

14. The process of claim 1, wherein the controlling of the reactor comprises, in response to an increase in the stripper fouling indicator:

increasing a reactor temperature;

selecting feed nozzles located at a higher elevation within the reactor for injection of the bitumen into the reactor; and/or decreasing solids circulation rate through the reactor.

15. The process of claim 1, wherein the controlling of the reactor comprises, in response to an increase in the stripper fouling indicator, increasing a reactor temperature.

16. The process of claim 1, wherein the stripper comprises a plurality of sheds extending into a downward flow path within the reactor and the controlling of the reactor mitigates fouling of the sheds of the stripper.

17. The process of claim 1, wherein the controlling of the reactor comprises:

monitoring a plurality of coking operation variables; and displaying the coking operation variables, including the stripper fouling indicator, on a dashboard for an operator.

* * * * *